United States Patent [19]

Cooley

[11] 4,033,037

[45] July 5, 1977

[54] METHOD AND MEANS FOR PUNCHING SHEET MEMBERS

[76] Inventor: Jerry A. Cooley, Rte. 1, New Virginia, Iowa 50210

[22] Filed: June 26, 1975

[21] Appl. No.: 590,699

[52] U.S. Cl. ..... 30/363

[51] Int. Cl.[2] ..... B26F 1/00

[58] Field of Search ..... 30/363

[56] References Cited

UNITED STATES PATENTS

| | | | |
|---|---|---|---|
| 313,027 | 2/1885 | Smith | 30/363 |
| 2,735,492 | 2/1956 | Cain | 30/363 |
| 3,763,513 | 10/1973 | Cooley | 30/300 |

FOREIGN PATENTS OR APPLICATIONS

| | | | |
|---|---|---|---|
| 21,170 | 4/1916 | Denmark | 30/363 |
| 21,171 | 4/1916 | Denmark | 30/363 |
| 479,386 | 7/1929 | Germany | 30/363 |

*Primary Examiner*—James L. Jones, Jr.
*Assistant Examiner*—J. T. Zatarga
*Attorney, Agent, or Firm*—Zarley, McKee, Thomte & Voorhees

[57] ABSTRACT

A device for punching a plurality of holes adjacent the edge of one or more sheet members comprises a pair of elongated jaw members pivotally joined intermediate their lengths in scissors-like fashion. A punch is carried on one end of one jaw member and an aligner is positioned in side by side relation to the punch in fixed spaced relationship therefrom. A punch die is carried by the other jaw member to receive the punch. The aligner and the punch each extend downwardly from the upper jaw member and terminate in lower ends, the lower end of the aligner protruding downwardly a predetermined distance below the lower end of the punch. The jaw members are pivotable from an open position wherein the punch and aligner are spaced from the die to a closed position wherein the punch is matingly received within the die and the aligner is positioned beside the die.

The method of the present invention comprises placing the sheet member in covering relation over the die, punching a punch downwardly through the sheet member and into the die so as to create a punched hole of predetermined configuration, removing the punch upwardly from the sheet member, realigning the sheet member below the punch by sliding the paper laterally and aligning the first punched hole below the aligner, moving the aligner downwardly into the first punched hole whereby the aligner positions and holds the paper against lateral movement, and punching the punch downwardly to form a second punched hole in a predetermined position with respect to the first punched hole.

6 Claims, 8 Drawing Figures

METHOD AND MEANS FOR PUNCHING SHEET MEMBERS

SUMMARY OF THE INVENTION

This invention relates to a method and means for punching holes in sheet members.

A commonly used method for binding involves punching a plurality of holes along the edges of the sheet members to be bound, and then inserting into the holes a binding ring having a plurality of fingers which are received within each of the holes.

The holes for such binding techniques are usually punched mechanically at commercial binding facilities. However, there is a need for a hand punch which can be used in the office or home for punching sheet members so that they can be bound in the above described manner. Several problems are encountered however in attempting to punch the holes one at a time. One problem is the difficulty in obtaining precisely the proper distance between each of the holes. Any errors are magnified as the holes are punched from one end of the line of holes to the other. A slight error in measurement as to the position of the second hole is carried forward to the position of the third hole and so on so that insertion of the binding ring is often times impossible after the line of holes has been punched.

The present invention utilizes a hand punch with an aligner member positioned in predetermined fixed relation to the punch and extending slightly below the lower end of the punch. The aligner member is inserted into the previously punched hole and thus positions the punch with respect to the sheet member so that a precise distance is obtained between the first punched hole and the second punched hole. Furthermore, a stripper member is provided on the present invention for removing the sheet members from both the punch and the aligner member when the punch and aligner member are withdrawn from the sheet members.

The end of the aligner member is tapered so as to fit easily into the punched out slot and to gently slide the sheet members into the proper position for receiving the punch. The fact that the aligner member extends below the punch permits the aligner member to meet the paper first and to align the paper prior to the time that the punch meets the paper. The aligner is received in an opening which is positioned beside the die for receiving the punch. The aligner opening is larger than the aligner cross section so that there is no binding or punching action between the aligner and the aligner opening.

The stripper and edge guide provided by the present invention are free from the paths of the punch die and the aligner member. They provide visibility so that the operator can easily sight and align the aligner member so that it will fit within the punched out slot of the sheet members.

Therefore, a primary object of the present invention is the provision of a method and means for punching sheet members.

A further object of the present invention is the provision of a method and means for punching sheet members wherein a plurality of punched holes may be provided in the edge of the sheet member in precise predetermined spaced relationship with respect to one another.

A further object of the present invention is the provision of a method and means for punching sheet members wherein the sheet members are stripped from the punch and aligner member each time the punch and aligner member are withdrawn upwardly.

A further object of the present invention is the provision of a method and means for punching sheet members wherein the sheet members are supported on a platform throughout the punching operation, and wherein the sheet members may be moved laterally between each punch without the need for lifting the sheet members or removing them from the platform of the punch.

A further object of the present invention is the provision of a method and means for punching sheet members wherein an aligner member is used which has a cross sectional configuration identical to the punch and to the holes which are made by the punch, the aligner member being capable of positioning and holding the sheet members in a precise position with respect to the punch whenever the aligner member is inserted within a previously punched hole.

A further object of the present invention is the provision of a device which is simple in construction, economical of manufacture and durable in use.

BRIEF DESCRIPTION OF THE FIGURES OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which;

DETAILED DESCRIPTION OF THE DRAWINGS

Figure 1:
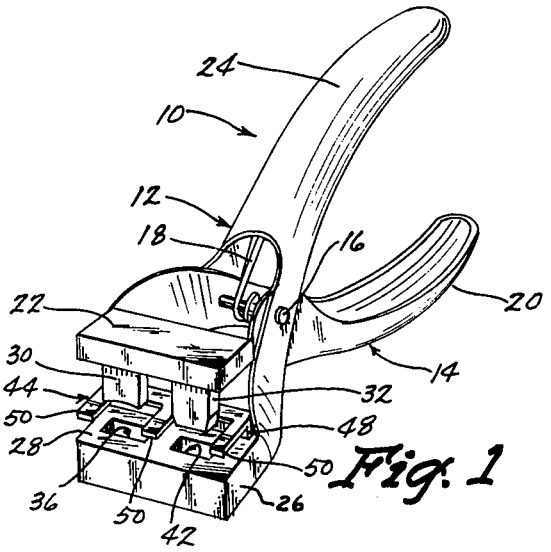
FIG. 1 is a perspective view of the present invention.

Referring to the drawings, the numeral 10 generally designates the punching device of the present invention. Device 10 comprises two lever members 12 and 14 which are pivoted intermediate their lengths by means of a pivot pin 16, and which are yieldably urged to a spread position by means of a spring 18.

Lever member 14 includes a handle 20 on one side of pivot pin 16 and an upper member 22 on the other side of pivot pin 16. Lever member 12 includes a handle 24 on one end thereof and a lower jaw member 26 on the other end thereof. Upper jaw member 22 provides a punch and aligner support and lower jaw member 26 porvides a flat support surface 28 which is adapted to support the sheet member for punching.

Mounted on upper jaw member 22 and extending downwardly therefrom are a punch 30 and an aligner 32. Punch 30 is shown to be in rectangular configuration, although any desired configuration could be used. The lower end of punch 30 is shown to be slightly concave, but this edge could be slanted or shaped in any other configuration which would facilitate a sharp cutting edge.

Figure 7:
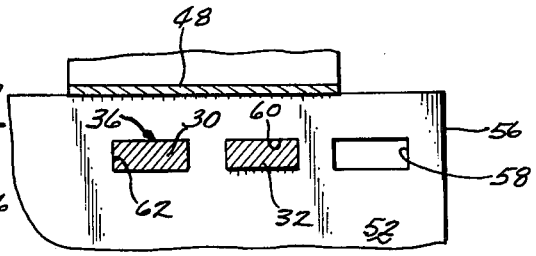
FIG. 7 is a sectional view taken along lines 7—7 of FIG. 6.

Aligner 32 includes at least a portion thereof which has a cross sectional configuration identical to the cross sectional configuration of punch 30. Preferably the lower end of aligner 32 has a tapered portion 34, but above this tapered portion the cross sectional configuration of aligner 32 is identical to punch 30 as can be readily seen in FIGS. 5 and 7. Aligner 32 also extends downwardly a slight distance below the lower end of punch 30 so that aligner 34 will engage the sheet member to be punched prior to the time that the punch will engage this sheet member. It should be noted that the upper edge of tapered portion 34 is a predetermined distance below the lower edge of punch 30. This distance should be equal to the thickness of the stack of sheet members to be punched so that the thickest cross section of the aligner 32 can protrude completely to the bottom of the stack of sheet members before punch 30 engages the sheet members. Punch 30 and aligner 32 are fixed to upper jaw member 22 so that their relationship is shown to be fixed, it also would not detract from the invention to provide means for adjusting the distance between aligner 30 and 32 as desired. However, means should be provided for securing the aligner 32 and punch 30 in their desired adjusted position during the punching process.

In registered alignment below punch 30 is a punch die 36 which is formed in support surface 28. Punch die 36 includes an upper portion 38 which is sized to receive punch 30 in close fitting relationship in the conventional manner for a punch and die. Below upper portion 38 is an enlarged portion 40 which permits the punched portion of the sheet member to drop downwardly.

In registered alignment below aligner 32 is an aligner hole or opening 42. Aligner hole 42 is slightly larger than aligner 32 and is also larger than die 36. The reason for this enlarged dimension of aligner hole 42 is to permit aligner 32 to enter therein without binding and without causing binding of the sheet members to be punched. It is possible to do away with aligner hole 42 if platform 28 does not extend below aligner 32. However, it is preferable to extend platform 28 laterally below aligner 32 so as to provide a satisfactory support for the sheet members to be punched. In this preferred form it is necessary to provide an aligner hole 42 to receive aligner 32.

Rigidly mounted to lower jaw member 26 is a stripper element 44. While stripper element 44 is shown to be fixed to lower jaw member 26, it also would be possible to provide selective adjustment means for permitting stripper element 44 to be adjusted to various positions on lower jaw member 26. Stripper element 44 includes a base portion 46 mounted to lower jaw member 26, and an upstanding edge guide portion 48, and a plurality of horizontal stripper members 50. Stripper members 50 extend around the margins of punch 30 and aligner 32 when punch 30 and aligner 32 are in their extreme lower positions (FIG. 6), but stripper members 50 are positioned so as to not interfere with the downward movement of punch 30 and aligner 32. Stripper members 50 are also spaced upwardly from support platform 28 so as to permit one or more sheet members 52 to be placed below stripper members 50 with their edges in abutting engagement against edge guide 48 as shown in FIGS. 4–7.

In operation, sheet members 52 are placed on support platform 28 with their edges in abutting engagement against edge guide 48. Handles 20, 24 are depressed so as to bring aligner 32 downwardly into aligner opening 42, to the position where punch 30 engages sheet members 52 (see FIGS 4 and 5). For purposes of description, the perpendicular edges of sheet members 52 are designated in FIGS. 4 and 5 by the numerals 54, 56. Sheet members 52 are moved along edge guide 48 with edges 54 in engagement therewith. This movement continues until edges 56 of sheet members 52 come into abutting engagement with aligner 32 as shown in FIG. 5.

Figure 2:
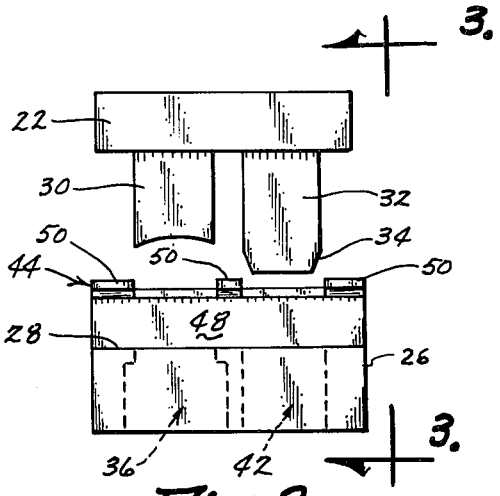
FIG. 2 is an end view of the jaw members of the present invention.
Figure 3:
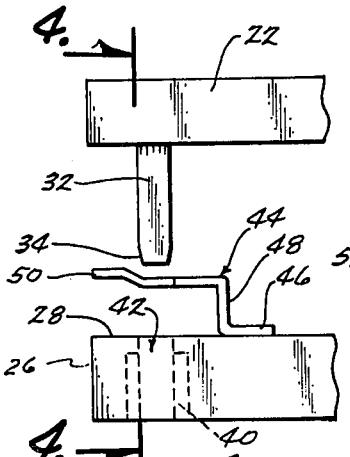
FIG. 3 is a sectional view taken along lines 3—3 of FIG. 2.
Figure 5:
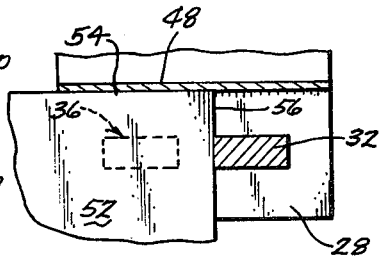
FIG. 5 is a sectional view taken along lines 5—5 of FIG. 4.

Once the position of the sheet members as shown in FIG. 5 is attained, handles 20, 24 are depressed fully to cause punch 30 to pierce sheet members 52 and punch a hole conforming to the shape of die 36 therein. Handles 20, 24 are then released and spring 18 causes them to spring to their extreme open position such as shown in FIGS. 1 and 2. As punch 30 and aligner 32 move upwardly to their open position, they tend to carry sheet members 52 with them, but stripper members 50 strip sheet members 52 from punch 30 and aligner 32.

After the first hole is punched, sheet member 52 is moved laterally with edge 54 in engagement with edge guide 48, and the first punched hole (designated by the numeral 58) is aligned below aligner 32. A second hole 60 is then punched with aligner 32 protruding downwardly within first hole 58 so as to position the paper. Thus a plurality of holes may be punched successively by aligning aligner 32 with the last punched hole.

Figure 4:
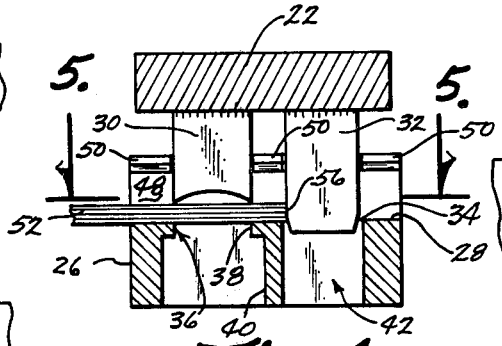
FIG. 4 is a sectional view taken along lines 4—4 of FIG. 3.
Figure 6:
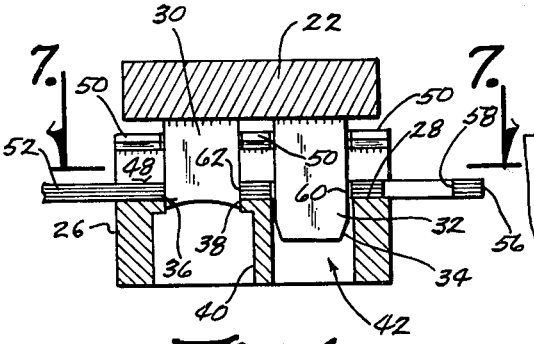
FIG. 6 is a view similar to FIG. 4 showing the punch in its extreme downward position.

This process of alignment is shown in detail in FIG. 6, with aligner 32 being aligned with a second hole 60 to permit punch 30 to punch a third hole 62. The sheet members 52 are positioned with hole 60 visually aligned below aligner 32. Aligner 32 is then depressed to approximately the same depth as shown in FIG. 4, but with aligner 32 protruding downwardly within second hole 60 of sheet members 52. The tapered lowered ends 34 of aligner 32 cause the sheet members to be shifted slightly to provide the precise alignment desired. Handles 20, 24 are then depressed fully so as to permit punch 30 to punch third hole 62 in sheet members 52. This process can be repeated successively along the entire edge of sheet members 52 so as to provide a line 64 of equally spaced holes as shown in FIG. 8.

Figure 8:
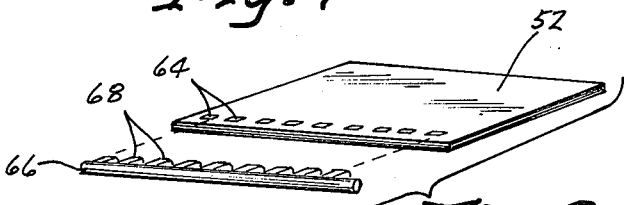
FIG. 8 is a perpective view of a plurality of sheet members which have been punched and the binding ring which is used to join the sheet members.

Referring to FIG. 8, a binding ring 66 is shown having a plurality of binding fingers 68 thereon. Unless the holes in line 64 are positioned precisely with respect to one another, they will not match the fingers 68. It has been found that the holes within line 64 must be accurate to within ± 1/64th of an inch in order to obtain the most desirable results. If the precise spacing of each hole is not obtained as the holes are punched along the length of sheet members 52, each error in positioning is carried forward to the next hole, with the ultimate result being that the last holes punched are completely out of position. Thus the precise positioning is very important when the holes are punched one at a time successively along the edge of sheet members 52. The punch of the present invention provides this precise positioning, and the insertion of a binding ring 66 is accomplished easily with the line 64 of holes which are punched by the present invention.

Several features of the present invention provide this advantageous result. The tapered end of the aligner permits the aligner to adjust slightly the position of the sheet members just prior to being punched so that they will be held in the proper position. The fact that the aligner meets the paper prior to the punch permits the aligner to align the paper immediately before it is punched. If the punch and aligner extended downwardly the same distance, the punch would hold the sheet members against movement in response to the aligner. It is important that the aligner have the same cross section as the punch so that it will move the paper and hold it against any substantial movement just prior to the time that the punch enters the paper. Because the aligner is spaced the desired distance from the punch, the holes are then punched to correspond with the position of the fingers in binding ring 66. The opening 42 for aligner 42 is larger than the aligner cross section, and this feature is important in that it reduces binding between the aligner and the sheet members and also between the aligner and the aligner opening.

One very important feature of the present invention is the face that the aligner and the punch are retractable from the paper because of the stripper members 50. Stripper members 50 hold the sheet members against upward movement as the aligner and punch move upwardly, thereby stripping the sheet members from the aligner and punch without the necessity of the operator doing so with his hands. These stripper members cannot cover the path of the punch and die during their upward and downward movement, and they should provide visibility where the aligner meets the punched out slot. Thus it is believed that the device accomplishes all of its stated objectives.

What is claimed is:

1. A device for punching a plurality of holes adjacent the edge of at least one sheet member, said device comprising:

a pair of elongated jaw members pivotally jointed intermediate their lengths in scissors-like fashion, a punch adjacent one end of one of said jaw members, an aligner on said one jaw member spaced a predetermined distance from said punch in a direction parallel to the pivotal axis of said jaw members;

said aligner and said punch each extending downwardly from said one jaw member and terminating in a lower end, said lower end of said aligner protruding downwardly a predetermined distance below said lower end of said punch.

a punch die sized to receive said punch and positioned on said other jaw member in registered alignment below said punch;

said jaw members being pivotal from an open position wherein said punch and aligner are spaced from said die to a closed position wherein said punch is matingly received within said die and said aligner is positioned beside said die said lower end of said aligner being positioned below said lower end of said punch in both said open and said closed positions of said jaw members, a stripper element mounted to said other jaw member including a plurality of spaced apart stripper members horizontally disposed in spaced relation above said other jaw member whereby at least one of said sheet members will fit in said space between said stripper members and said other jaw member, said stripper members being adjacent the inner and outer lateral margins of both said punch and said aligner as said jaw members move between said open and closed positions, both said punch and said aligner being in spaced relation above said stripper members when said jaw members are in said open position.

2. A device according to claim 1 wherein the length of said aligner is greater than the distance between said stripper members and said other jaw member.

3. A device according to claim 1 wherein said stripper portion includes edge guide means for engaging said edge of said sheet member, said stripper portion being positioned adjacent said punch and said aligner when said jaw members are in said closed position whereby said stripper portion engages said sheet member and strips said sheet member from said punch and aligner when said jaw members move to said open position.

4. A device according to claim 1 wherein said aligner has at least one portion thereof with a cross sectional shape which is identical in size and shape to the cross sectional shape of said punch, the remainder of the said aligner being no larger in cross section than said one portion.

5. A device according to claim 4 wherein said aligner includes a tapered portion of reduced cross section adjacent its lower end, the uppermost edge of said tapered portion being a predetermined distance below the lower edge of said punch.

6. A device for punching a plurality of holes adjacent the edge of at least one sheet member, said device comprising:

a pair of elongated jaw members pivotally joined intermediate their length in scissors-like fashion, a punch adjacent one end of one of said jaw members, an aligner on said one jaw member spaced a predetermined distance from said punch in a direction parallel to the pivotal axis of said jaw members;

said aligner and said punch each extending downwardly from said one jaw member and terminating in a lower end, said lower end of said aligner protruding downwardly a predetermined distance below said lower end of said punch;

a punch die sized to receive said punch and positioned on said other jaw member in registered alignment below said punch;

said jaw members being pivotal from an open position wherein said punch and aligner are spaced from said die to a closed position wherein said punch is matingly received within said die and said aligner is positioned beside said die;

said lower end of said aligner being positioned below said lower end of said punch in both said open and said closed positions of said jaw members;

said other jaw member including an aligner hole therein positioned beside said die and in registered alignment below said aligner so as to matingly receive said aligner when said jaw members are in said closed position, said aligner hole having a cross sectional size which is larger than that of said aligner and also which is larger than that of said die.

* * * * *